US006748754B2

(12) United States Patent
Matsumoto et al.

(10) Patent No.: US 6,748,754 B2
(45) Date of Patent: Jun. 15, 2004

(54) MULTISTAGE ROTARY COMPRESSOR AND REFRIGERATION CIRCUIT SYSTEM

(75) Inventors: Kenzo Matsumoto, Ora-gun (JP); Noriyuki Tsuda, Ora-gun (JP); Haruyuki Yamasaki, Ora-gun (JP); Kazuya Sato, Ora-gun (JP); Masaya Tadano, Niita-gun (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 10/386,672

(22) Filed: Mar. 13, 2003

(65) Prior Publication Data

US 2003/0172666 A1 Sep. 18, 2003

(30) Foreign Application Priority Data

Mar. 13, 2002 (JP) ..... 2002-068883
Mar. 13, 2002 (JP) ..... 2002-068926
Apr. 1, 2002 (JP) ..... 2002-098556

(51) Int. Cl.[7] ..... F25B 7/00
(52) U.S. Cl. ..... 62/175; 62/196.4; 62/510
(58) Field of Search ..... 62/175, 196.4, 62/510; 418/209, 212

(56) References Cited

U.S. PATENT DOCUMENTS 5,322,424 A * 6/1994 Fujio ..... 418/11
6,189,335 B1 * 2/2001 Ebara et al. ..... 62/510
6,581,408 B1 * 6/2003 Tadano et al. ..... 62/513
2003/0106330 A1 * 6/2003 Yamasaki et al. ..... 62/196.4
2003/0126885 A1 * 7/2003 Ebara et al. ..... 62/505

FOREIGN PATENT DOCUMENTS

| | | |
|---|---|---|
| JP | 2-294586 | 12/1990 |
| JP | 2-294587 | 12/1990 |
| JP | 11-62863 | 3/1999 |
| JP | 11-230072 | 8/1999 |
| WO | WO 01/16490 A1 | 3/2001 |

OTHER PUBLICATIONS

European Search Report dated Nov. 10, 2003.

* cited by examiner

*Primary Examiner*—Marc Norman
(74) *Attorney, Agent, or Firm*—Armstrong, Kratz, Quintos, Hanson & Brooks, LLP

(57) ABSTRACT

In a multistage rotary compressor using a refrigerant such as carbon dioxide ($CO_2$) and the like which becomes high in a discharge pressure, operating efficiency thereof can be enhanced by appropriately setting the ratio between displacement of the respective rotary compression elements and the areas of discharge ports thereof. In the multistage rotary compressor comprising an electric element in a hermetic shell case, and first and second rotary compression elements which are driven by the electric element, wherein a refrigerant which is compressed and discharged by the first rotary compression element is drawn into and compressed by the second rotary compression element and discharged thereby, wherein the ratio of S2/S1 is set to be smaller than ratio of V2/V1, where S1 is an area of a discharge port of the first rotary compression element, S2 is an area of a discharge port of the second rotary compression element, V1 is displacement of the first rotary compression element, and V2 is displacement of the second rotary compression element.

10 Claims, 8 Drawing Sheets

MULTISTAGE ROTARY COMPRESSOR AND REFRIGERATION CIRCUIT SYSTEM

FIELD OF THE INVENTION

The invention relates to a multistage compression type rotary compressor (hereinafter referred to as multistage rotary compressor) comprising an electric element in a hermetic shell case, and first and second rotary compression elements which are driven by the electric element, wherein a refrigerant which is compressed by the first rotary compression element and discharged is drawn into and compressed and discharged by the second rotary compression element, and a refrigeration circuit system using the multistage rotary compressor.

BACKGROUND OF THE INVENTION

In a conventional multistage rotary compressor of this type, for example, in a multistage rotary compressor of an internal intermediate pressure type, for example, as disclosed in JP-H 2-294586 and JP-H 2-294587 and a refrigeration circuit system using the multistage rotary compressor, a refrigerant is drawn into a low pressure chamber of a cylinder through a suction port of a first rotary compression element (first stage compression mechanism), and it is compressed during the operation of a roller and a vane and is changed into a refrigerant having an intermediate pressure (hereinafter referred to as intermediate pressure refrigerant) and the intermediate pressure refrigerant is discharged from a high pressure chamber of the cylinder to a hermetic shell case through a discharge port and a noise eliminating chamber.

The intermediate pressure refrigerant in the hermetic shell case is drawn into the low pressure chamber of the cylinder through a suction port of a second rotary compression element (second stage compression mechanism), where it is subjected to a second stage compressions during the operation of the roller and vane and is changed into a refrigerant having a high temperature and high pressure (hereinafter referred to as high temperature and high pressure refrigerant), which in turn flows from the high pressure chamber into a radiator or the like such as an external gas cooler or the like constituting a refrigeration circuit system unit through a discharge port and the noise eliminating chamber, where the heat is radiated to perform heating operation, then throttled by an expansion valve (pressure reducing device) and enters an evaporator, where heat of the refrigerant is withdrawn and the refrigerant is evaporated, thereafter it is drawn into the first rotary compression element. This cycle is repeated.

In such a multistage rotary compressor, the cylinders of the first and second rotary compression elements and the noise eliminating chamber communicate with each other by the discharge port. A discharge valve for freely opening and closing the discharge port is provided in the noise eliminating chamber. The discharge valve is formed of an elastic member made of longitudinal substantially rectangular metal sheet wherein one side of the discharge valve is brought into contact with the discharge port to seal it and the other side of the discharge valve is fixed to an attachment port by a caulking pin with a predetermined distance relative to the discharge port.

The refrigerant which is compressed by the cylinder to reach a predetermined pressure pushes the discharge valve which closes the discharge port to open the discharge port and then it is discharged into the noise eliminating chamber.

When the discharge of the refrigerant approaches an end time, the discharge vale is structured to block off the discharge port. At this time, the refrigerant remains in the discharge port which is returned to the cylinder and is expanded again.

Although the re-expansion of the refrigerant remaining in the discharge port incurs the lowering of the compression efficiency, the conventional multistage rotary compressor sets the ratio of S2 to S1 (S2/S1) to be the same as the ratio of V2 to V1 (V2/V1) where SI is an area of a discharge port of the first rotary compression element and S2 is an area of a discharge port of the second rotary compression element, V1 is displacement of the first rotary compression element and V2 is displacement of the second rotary compression element.

Meanwhile, in a refrigeration circuit system such as a cooling, heating and hot water supply unit using refrigerant, e.g., Carbon dioxide ($CO_2$), which is large in difference between high and low pressures, a discharge pressure of the second rotary compression element (second stage) is normally controlled to a very high pressure ranging from 10 MPa to 13 MPa so that volume flow at the discharge port of the second compression element is very small. Accordingly, even if the area of the discharge port of the second rotary compression element is made small, it is hardly susceptible to a passage resistance. Nonetheless, if the ratio of S2/S1 of the discharge port is set to a conventional ratio in the multistage rotary compressor using such a refrigerant, there arises a problem that a compression efficiency (operation efficiency) is lowered.

In the multistage rotary compressor using such a refrigerant, a discharge refrigerant pressure reaches 1 MPa at a refrigerant discharge side of the second rotary compression element (second stage compression mechanism) which becomes a high pressure at an ambient temperature of about +20° C. as shown in FIG. 5, while it reaches 9 MPa at the first rotary compression element forming a lower stage, which in turn becomes an intermediate pressure in the hermetic shell case (pressure in a case). A pressure (low pressure) drawn by the first rotary compression element is about 5 MPa.

However, if an evaporation temperature of the refrigerant increases when an ambient temperature increases, a pressure drawn by the first rotary compression element increases so that a pressure at the refrigerant discharge side (first stage discharging pressure) also increases as shown in FIG. 5. When the ambient temperature becomes not less than +32° C., the pressure at the refrigerant discharge side (intermediate pressure) of the first rotary compression element becomes higher than that (second stage discharging pressure) of the second rotary compression element so that there occurs an inverse of the pressure between the intermediate pressure and a high pressure, arising a problem that a vane of the second rotary compression element is prone to jump to generate noises and the operation of the second rotary compression element becomes unstable.

Although in the conventional multistage rotary compressor, a pressure reversing phenomenon, between the pressure (intermediate pressure) at the refrigerant drawing side of the second rotary compression element and the pressure (high pressure) at the refrigerant discharge side of the first rotary compression element caused by excessive compression by the first rotary compression element is avoided by controlling the amount of circulation of the refrigerant by the expansion valve in the refrigeration circuit, namely, by restraining (throttling) the amount of refrigerant which is introduced into the first rotary compression element. However, in such a case, there arises a problem that the performance of the multistage rotary compressor is lowered because the amount of refrigerant which circulates in the refrigeration circuit is reduced. In addition, the pressure in the hermetic shell case increases, arising a problem that the pressure exceeds an allowable limit of the hermetic shell case.

SUMMARY OF THE INVENTION

The invention has been developed to solve the technical problems of the conventional multistage rotary compressor. It is a first object of the invention to provide a multistage rotary compressor using a refrigerant such as carbon dioxide ($CO_2$) which becomes high in a discharge pressure, and improving operating efficiency by appropriately setting the ratio between the air volumes of the respective rotary compression elements and the areas of discharge port thereof. It is another object of the invention to provide a multistage rotary compressor capable of avoiding a pressure reversing phenomenon where discharge pressures of the first and second rotary compression elements are reversed by an ambient temperature, and a refrigeration circuit system using the multistage rotary compressor.

That is, since the multistage rotary compressor of the first aspect of the invention comprises an electric element in a hermetic shell case, and first and second rotary compression elements being driven by the electric element, wherein a refrigerant which is compressed and discharged by the first rotary compression element is drawn into and compressed by the second rotary compression element and discharged thereby, and the multistage rotary compressor is characterized in that ratio of S2/S1 is set to be smaller than ratio of V2/V1, where S1 is an area of a discharge port of the first rotary compression element, S2 is an area of a discharge port of the second rotary compression element, V1 is displacement of the first rotary compression element, and V2 is displacement of the second rotary compression element, it is possible to reduce the amount of a high pressure gas remaining in the discharge port of the second rotary compression element by further reducing the area S2 of the discharge port of the second rotary compression element.

Particularly, in the second aspect of the invention, if the ratio of S2/S1 is set to be not less than 0.55 to not more than 0.85 times as large as the ratio of V2/V1, an operating efficiency of the rotary compressor can be further enhanced.

Further, in the third aspect of the invention, if the ratio of S2/S1 is set to be not less than 0.55 to not more than 0.67 times as large as the ratio of V2/V1, the multistage rotary compressor achieves the effect particularly under circumstances such as at a cold district or the like where the flow rate of a refrigerant is small.

Still further, in the fourth aspect of the invention, if the ratio of S2/S1 is set to be not less than 0.69 to not more than 0.85 times as large as the ratio of V2/V1, the multistage rotary compressor has a dramatic effect under circumstances such as at a warm district or the like where the flow rate of a refrigerant is large.

According to the fifth aspect of the invention, since the refrigeration circuit system comprises an electric element in a hermetic shell case enclosure, and first and second rotary compression elements being driven by the electric element, wherein an intermediate pressure refrigerant which is compressed by the first rotary compression element is drawn and compressed by the second rotary compression element and discharged thereby, and the multistage rotary compressor comprises a communication path for communicating between a path through which the intermediate pressure refrigerant compressed by the first rotary compression element flows and a refrigerant discharge side of the second rotary compression element, and a valve unit for opening and closing the communication path, wherein the valve unit opens the communication path when a pressure of the intermediate pressure refrigerant becomes higher than a pressure at the refrigerant discharge side of the second compression element, it is possible to control the intermediate pressure to be not more than the pressure at the refrigerant discharge side of the second rotary compression element by the valve unit.

As a result, it is possible to avoid in advance an inconvenience of the reverse of pressures at the refrigerant suction side and the refrigerant discharge side of the second rotary compression element, and also avoid an unstable operating condition or the generation of noises, and not reduce the amount of circulation of the refrigerant, thereby avoiding the lowering of performance of the multistage rotary compressor.

In the sixth aspect of the invention, since the multistage rotary compressor further comprises a cylinder constituting the second rotary compression element, a noise eliminating chamber for discharging the refrigerant compressed in the cylinder, wherein the intermediate pressure refrigerant which is compressed by the first rotary compression element is discharged into the hermetic shell case, and the second rotary compression element draws the intermediate pressure refrigerant in the hermetic shell case thereinto, and wherein the communication path is formed in a wall forming the noise eliminating chamber for allowing the hermetic shell case enclosure to communicate with the noise eliminating chamber, and the valve unit is provided in the noise eliminating chambers or the communication path, the communication path which communicates between the path through which the intermediate pressure refrigerant compressed by the first rotary compression element flows and the refrigerant discharge side of the second rotary compression element, and the valve unit for opening and closing the communication path can be concentrated at the noise eliminating chamber of the second rotary compression element, so that the entire structure of the multistage rotary compressor can be simplified and the entire dimensions thereof can be made small.

In the seventh aspect of the invention, since the refrigeration circuit system comprises a multistage rotary compressor formed of an electric element in a hermetic shell case, and first and second rotary compression elements being driven by the electric element, wherein a refrigerant which is compressed by the first rotary compression element is compressed by the second rotary compression element, a gas cooler into which the refrigerant discharged from the second rotary compression element flows, a pressure reducing device connected to an outlet side of the gas cooler, and an evaporator connected to an outlet side of the pressure reducing device, wherein the refrigerant discharged from the evaporator is compressed by the first rotary compression element, the refrigeration circuit system further comprises a bypath circuit for supplying the refrigerant discharged from the first rotary compression element to the evaporator, a flow regulating valve capable of controlling flow rate of the refrigerant flowing in the bypath circuit, and control means for controlling the flow regulating valve and the pressure reducing device, wherein the control means normally closes the flow regulating valve and increases flow rate of the refrigerant flowing in the bypath circuit by the flow regulating valve in response to the increase of pressure at the refrigerant discharge side of the first rotary compression element, the refrigerant discharged from the first rotary compression element can be let out toward the evaporator via the bypath circuit by the flow regulating valve when the pressure at the refrigerant discharge side of the first rotary compression element increases. As a result, it is possible to avoid in advance an inconvenience of the reverse of the pressure at the refrigerant discharge side of the first rotary compression element, which increases abnormally, e.g., owing to high ambient temperature, to the pressure at the refrigerant discharge side of the second rotary compressor element are reversed.

In the eighth aspect of the invention, since the refrigerant compressed by the first rotary compressor element is discharged into the hermetic shell case and the second rotary compression element draws the refrigerant in the hermetic shell case thereinto; and wherein the control means opens the flow regulating valve when a pressure in the hermetic shell case reaches a predetermined pressure, it is possible to avoid in advance the drawback that the pressure in the hermetic shell case exceeds the allowable limit of the pressure in the hermetic shell case when the pressure at the refrigerant discharge side of the first rotary compression element increases provided that the flow regulating valve opens when the pressure in the hermetic shell case, for example, approaches the allowable pressure in the hermetic shell case.

Further, in the ninth aspect of the invention, since the control means opens the flow regulating valve when the pressure at the refrigerant discharge side of the first rotary compression element is higher than or approaches a pressure at the refrigerant discharge side of the second rotary compression element, it is possible to avoid the pressure reversing phenomenon between the pressure at the refrigerant discharge side of the first rotary compression element and that of the second rotary compression element, thereby avoiding in advance an inconvenience that the second rotary compression element falls into an unstable operating condition.

Further, in the tenth aspect of the invention, since the control means fully opens both the pressure reducing device and the flow regulating valve when the evaporator performs defrosting operation, it is possible to eliminate frost generated in the evaporator by the refrigerant compressed by the first rotary compression element and the refrigerant compressed by the second rotary compression element and also possible to avoid the pressure reversing phenomenon between the pressure at the refrigerant discharge side of the first rotary compression element and that of the second rotary compression element while more efficiently defrosting the frost grown up in the evaporator.

PREFERRED EMBODIMENT OF THE INVENTION

A multistage rotary compressor according to the invention and a refrigeration circuit system using the same are described now in detail with reference to the attached drawings.

Figure 1:
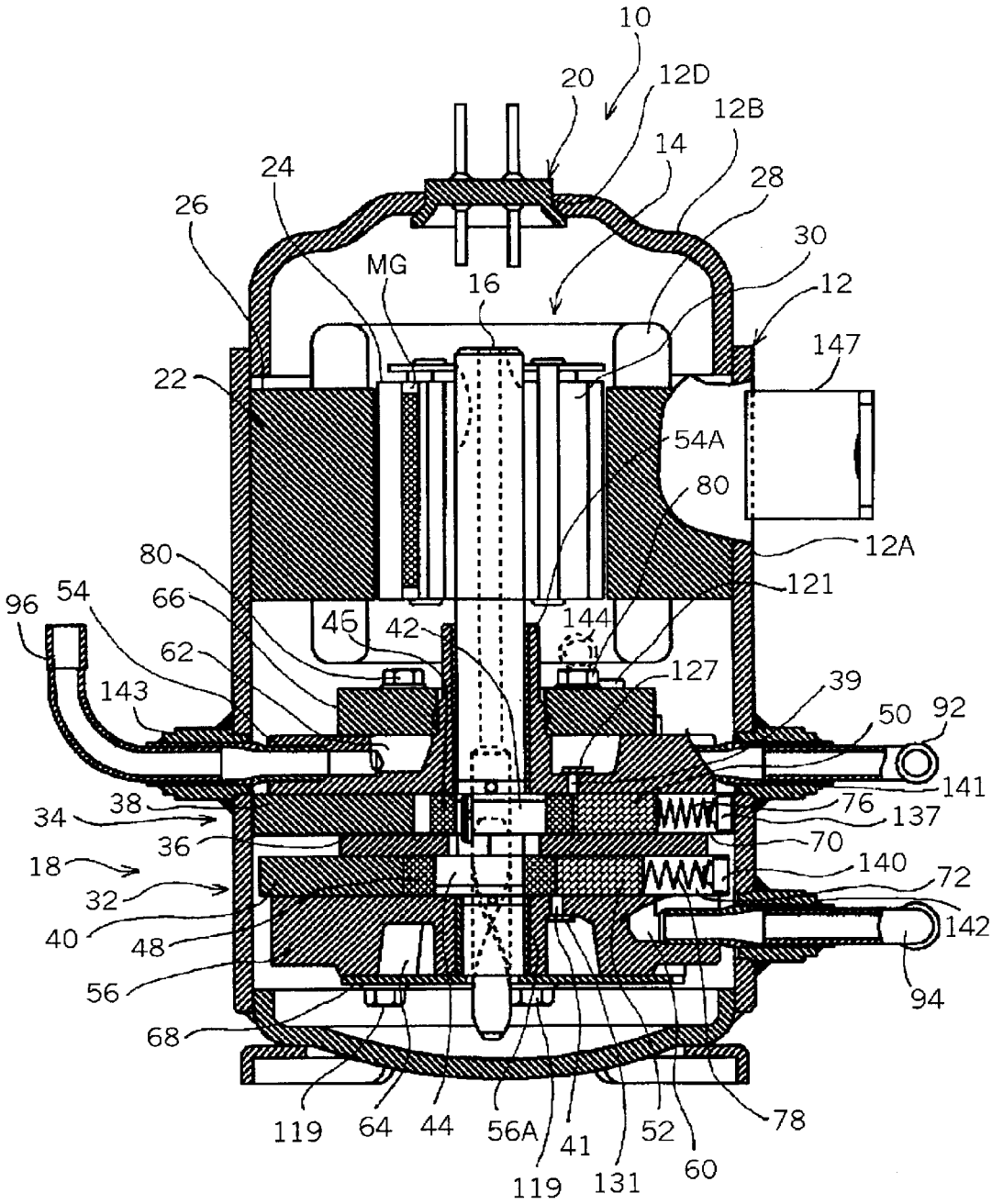
FIG. 1 is a longitudinal sectional view of a multistage rotary compressor according to a first embodiment of the invention.

FIG. 1 is a longitudinal sectional view showing the structure of a multistage (two stages) rotary compressor 10 having an inner intermediate pressure therein and provided with first and second rotary compression elements 32, 34 according to the first embodiment of the invention.

As shown in FIG. 1, the multistage rotary compressor 10 has an intermediate pressure therein and a refrigerant formed of, e.g., a carbon dioxide ($CO_2$) and comprises a hermetic shell case 12 serving as a case formed of a cylindrical shell case 12A made of a steel plate, a substantially bowl-shaped end cap (cover) 12B for closing an upper opening of the shell case 12A, an electric element 14 disposed at and accommodated in an upper side of an inner space of the shell case 12A of the hermetic shell case 12, and a rotary compression mechanism 18 formed of a first rotary compression element 32 (first stage compression mechanism) and a second rotary compression element 34 (second stage compression mechanism) which are respectively disposed under the electric element 14 and driven by a rotary shaft 16 of the electric element 14.

The hermetic shell case 12 has a bottom serving as an oil reservoir. A circular attachment hole 12D is formed on the upper surface of the end cap 12B at the center thereof, and a terminal 20 (wiring thereof is omitted in description) for supplying a power to the electric element 14 is fixed to the attachment hole 12D by welding.

The electric element 14 comprises a stator 22 which is annularly attached to the inner peripheral surface of the upper space of the hermetic shell case 12, and a rotor 24 inserted into and installed inside the stator 22 with a slight clearance. The rotary shaft 16 extended vertically is fixed to the rotor 24.

The stator 22 comprises a laminated body 26 formed by laminating doughnut-shaped electromagnetic steel plates and a stator coil 28 which is wound around the teeth of the laminated body 26 by a direct winding (concentrating winding) system. The rotor 24 is formed by inserting a permanent magnet MG in a laminated body 30 made of electromagnetic steel plates like the stator 22.

An intermediate partition plate 36 is held tight between the first rotary compression element 32 and the second rotary compression element 34. That is, both the first rotary compression element 32 and the second rotary compression element 34 comprise the intermediate partition plate 36, upper and lower cylinders 38, 40 disposed over and under the intermediate partition plate 36, upper and lower eccentric portions 42, 44 provided on the rotary shaft 16, upper and lower rollers 46, 48 which are eccentrically rotated inside the upper and lower cylinders 38, 40 while engaged in the upper and lower eccentric portions 42, 44 with a 180° phase difference therebetween, upper and lower vanes 50, 52 which are brought into contact with the upper and lower rollers 46, 48 and partitioning the upper and lower cylinders 38, 40 into a lower pressure chamber and a high pressure chamber respectively, and an upper support member 54 and a lower support member 56 as supporting members serving as bearings of the rotary shaft 16 by closing an upper opening face of the upper cylinder 38 and the lower opening face of the lower cylinder 40.

Figure 2:
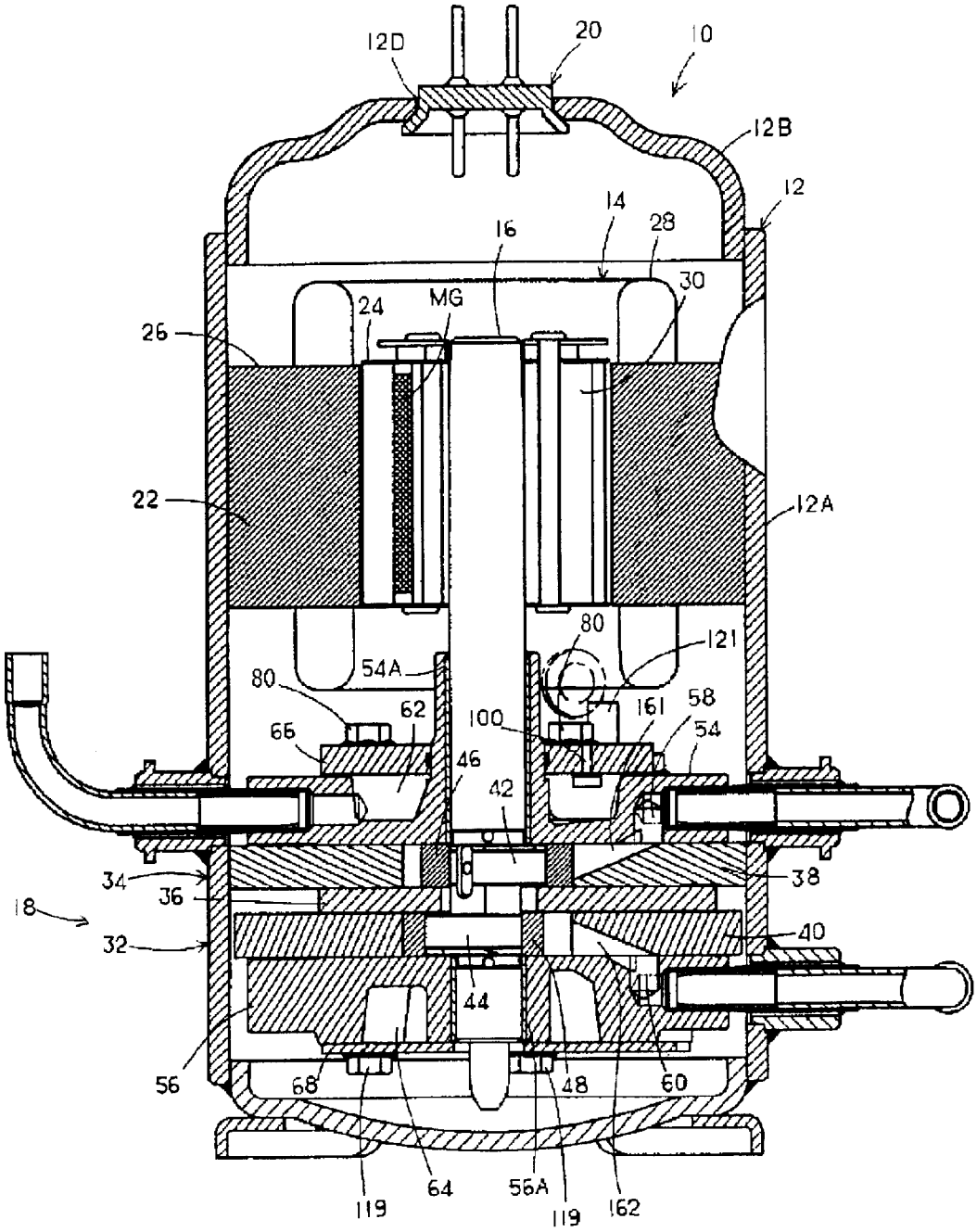
FIG. 2 is a longitudinal sectional view of a multistage rotary compressor according to a second embodiment of the invention.

There are provided in the upper support member 54 and lower support member 56, as shown in FIG. 2, drawing paths 58, 60 which communicates between the inner portions of the upper and lower cylinders 38 and 40 through suction ports 161, 162, and noise eliminating chambers 62, 64 which are formed by closing recessed portions of the upper support member 54 and the lower support member 56 by a cover serving as a wall thereof. That is, the noise eliminating chamber 62 is closed by an upper cover 66 serving as a wall for forming the noise eliminating chamber 62 and the noise eliminating chamber 64 is closed by a lower cover 68 serving as a wall forming the noise eliminating chamber 64. The electric element 14 is provided over the upper cover 66 with a predetermined distance relative to the upper cover 66.

In this case, a bearing 54A is formed on the center of the upper support member 54 while uprising thereon. A bearing 56A is formed on the center of the lower support member 56 while penetrating it, wherein the rotary shaft 16 is held by the bearing 54A of the upper support member 54 and the bearing 56A of the lower support member 56.

In this case, the lower cover 68 is made of a doughnut-shaped circular steel plate for forming the noise eliminating chamber 64 which communicates with the interior of the lower cylinder 40 of the first rotary compression element 32, and it is fixed to the lower support member 56 by screwing main bolts 119, 119, at four spots on the periphery thereof, thereby forming the noise eliminating chamber 64 communicating with the interior of the lower cylinder 40 of the first rotary compression element 32 through a discharge port 41. Tip ends of the main bolts 119, 119, . . . are screwed with the upper support member 54.

A discharge valve 131 for closably closing the discharge port 41 is provided on the upper surface of the noise eliminating chamber 64. The discharge valve 131 is formed of an elastic member formed of a longitudinal substantially rectangular metal plate, and a bucker valve serving as a discharge valve restraining plate, not shown, is disposed under the discharge valve 131, and is attached to the lower support member 56, wherein one side of the discharge valve 131 is brought into contact with the discharge port 41 to seal the discharge port 41 while the other side of the discharge valve 131 is fixed to an attachment hole, not shown, of the lower support member 56 by a caulking pin with a predetermined distance relative to the discharge port 41.

The refrigerant which is compressed in the lower cylinder 40 and reaches a predetermined pressure pushes down the discharge valve 131 from the above in the figure, which closes the discharge port 41, thereby opening the discharge port 41 so that it is discharged into the noise eliminating chamber 64. At this time, since the discharge valve 131 is fixed to the lower support member 56 at the other side, one side thereof which is brought into contact with the discharge port 41 is warped up, and it is brought into contact with a bucker valve, not shown, which restricts the amount of opening of the discharge valve 131. When the discharge of the refrigerant approaches an end time, the discharge valve 131 is moved away from the bucker valve to close the discharge port 41.

The noise eliminating chamber 64 of the first rotary compressor element 32 and the interior of the hermetic shell case enclosure 12 communicate with each other through a communication port, not shown, which penetrates the upper cover 66, the upper and lower cylinders 38 and 40, and the intermediate partition plate 36. In this case, an intermediate discharge pipe 121 is provided on the upper end of the communication port, and the intermediate pressure refrigerant which is compressed by the first rotary compression element 32 is discharged to the hermetic shell case 12 through the intermediate discharge pipe 121.

The upper cover 66 forms the noise eliminating chamber 62 which communicates with the interior of the upper cylinder 38 of the second rotary compression element 34 through a discharge port 39, wherein the electric element 14 is provided over the upper cover 66 with a predetermined distance relative to the upper cover 66. The upper cover 66 is made of a substantially doughnut-shaped circular steel plate in which a hole is formed through which the bearing 54A of the upper support member 54 penetrates. The upper cover 66 is fixed to the upper support member 54 from the above at the periphery thereof by the four main bolts 80, 80, . . . . Accordingly, tip ends of the main bolts 80, 80, . . . are screwed with the lower support member 56.

A discharge valve 127 for closably closing the discharge port 39 is provided on the lower surface of the noise eliminating chamber 62 the discharge valve 127 is formed of an elastic member made of a longitudinal substantially rectangular metal plate, and a bucker valve 128 serving as a discharging valve restraining plate is disposed over the discharge valve 127 in the same manner as the discharge valve 131 and it is attached to the upper support member 54. One side of the discharge valve 127 is brought into contact with the discharge port 39 to seal it while the other side thereof is fixed to an attachment port 129 of the upper support member 54 by a caulking pin with a predetermined distance relative to the discharge port 39.

The refrigerant which is compressed in the upper cylinder 38 and reaches a predetermined pressure pushes up the discharge valve 127 from the below in the figure, which closes the discharge port 39 to open the discharge port 39 so that it is discharged toward the noise eliminating chamber 62. At this time, since the discharge valve 127 is fixed to the upper support member 54 at the other side, one side thereof which is brought into contact with the discharge port 39 is warped up and is brought into contact with a bucker valve, not shown, which restricts the amount of the opening of the discharge valve 127. When the discharge of the refrigerant approaches an end time, the discharge valve 127 is moved away from the bucker valve to close the discharge port 39.

In the first embodiment, the ratio of S2/S1 is set to be smaller than the ratio of V2/V1, for example, the ratio of S2/S1 is set to be not less than 0.55 to not more than 0.85 times as large as the ratio of V2/V1, where S2 is an area of the discharge port 39 of the second rotary compression element 34 and S1 is an area of a discharge port 41 of the first rotary compression element 32, V1 is displacement of the first rotary compression element 32, and V2 is displacement of the second rotary compressor element 34.

Accordingly, since the area of the discharge port 39 of the second rotary compression element 34 becomes smaller, the amount of higher pressure refrigerant remaining in the discharge port 39 can be reduced.

That is, since the amount of high pressure refrigerant remaining in the discharge port 39 can be reduced, the amount of refrigerant which returns to the upper cylinder 38 through the discharge port 39 and is re-expanded therein can be reduced, thereby improving compression efficiency of the second rotary compressor element 34 so that the performance of the rotary compressor can be enhanced to a large extent.

Although the volume flow in the discharge port 39 of the second rotary compression element 34 is very small, the ratio of S2/S1 is set to be not less than 0.55 to not more than 0.85 times as large as the ratio of V2/V1, where S1 is the area of the discharge port 41 of the first rotary compression element 32 and the S2 of the area of the discharge port 39 of the second rotary compression element 34, V1 is displacement of the first rotary compression element 32 and the V2 is displacement of the second rotary compression element 34 so that a passage resistance of the discharge port 39 is controlled as much as possible so as not significantly impede the circulation's of the refrigerant. Accordingly, it is possible to enhance the performance of the compressor because an effect caused by the reduction of pressure loss of the refrigerant caused by the re-expansion of the refrigerant remaining in the discharge port 39 is superior to the deterioration of the flowing of the refrigerant caused by the increase of the passage resistance.

There are provided in the upper and lower cylinders 38, 40, guide grooves, not shown, for accommodating the upper and lower vanes 50, 52 and accommodation portions 70, 72 which are positioned outside the guide grooves and accommodate springs 76, 78 serving as spring members. The accommodation portions 70, 72 open toward the guide grooves and the hermetic shell case 12 (shell case 12A). The springs 76, 78 are brought into contact with outer end portions of the upper and lower vanes 50, 52 to always urge the upper and lower vanes 50, 52 toward the upper and lower rollers 46, 48. Metal plugs 137, 140 are provided on the springs 76, 78 of the accommodation portions 70, 72 at the side of the hermetic shell case 12, and serve to prevent the springs 76, 78 from coming off.

With such an arrangement of the multistage rotary compressor, the first object of the invention is achieved, namely, in the multistage rotary compressor using the refrigerant such as carbon dioxide ($CO_2$) or the like which becomes high pressure in discharge pressure, the ratio of the air volumes of the respective first and second rotary compression elements to the areas of the discharge ports thereof is appropriately set, thereby improving an operating efficiency. The operation of the multistage rotary compressor will be described later in detail.

FIG. 2 is a longitudinal sectional view showing the structure of a multistage (two stages) rotary compressor 10 having internal intermediate pressure therein and first and second rotary compression elements 32, 34 according to a second embodiment of the invention. Components shown in FIG. 2 which are the same as those shown in FIG. 1 are depicted by the same reference numerals. A communication path 100 of the invention is formed in an upper cover 66 of the second rotary compression element 34. The communication path 100 communicates between an interior of a hermetic shell case 12 serving as a path through which a intermediate pressure refrigerant compressed by the first rotary compression element 32 flows and an interior of a noise eliminating chamber 62 serving as a refrigerant discharge side of the second rotary compression element 34. The communication path 100 is a hole formed by penetrating the upper cover 66 vertically thereto, and an upper end of the communication path 100 opens toward the hermetic shell case 12 and the lower end thereof opens toward the noise eliminating chamber 62. Further, an release valve 101 serving as a valve unit is provided at a lower end opening of the communication path 100, and is attached to the lower surface of the upper cover 66.

The release valve 101 is positioned at the upper side of the noise eliminating chamber 62 and is formed of an elastic member made of a longitudinal substantially rectangular metal plate in the same manner as the discharge valve 127. A bucker valve 102 serving as an release valve restraining plate is disposed at the lower side of the release valve 101 and is attached to the lower surface of the upper cover 66. One side of the release valve 101 is brought into contact with the lower end opening of the communication path 100 to seal it and the other side thereof is fixed to an attachment port 103 provided on the lower surface of the upper cover 66 by a screw 104 with a predetermined distance relative to the communication path 100 as shown in FIG. 3.

Figure 3:
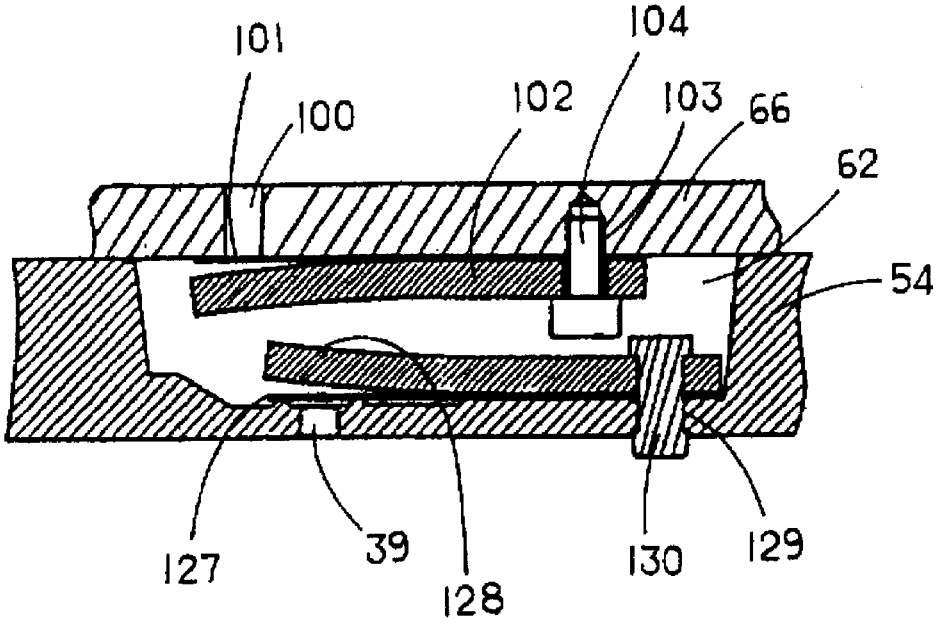
FIG. 3 is an enlarged sectional view of a communication path of a second rotary compression element of the multistage rotary compressor in FIG. 2.

When the pressure in the hermetic shell case 12 becomes higher than a pressure at the refrigerant discharge side of the second rotary compression element 34, the release valve 101 closing the communication path 100 is pushed down to open the lower end opening of the communication path 100, so that the refrigerant in the hermetic shell case 12 is forced to flow into the noise eliminating chamber 62 as shown in FIG. 3. At this time, the release valve 101 is fixed to the upper cover 66 at the other side, one side thereof which is brought into contact with the communication path 100 is warped up to bring into contact with the bucker valve 102 which restricts the amount of the opening of the release valve 101. On the other hand, when the pressure of the refrigerant in the hermetic shell case 12 becomes lower than the pressure of the noise eliminating chamber 62, the release valve 101 is moved away from the bucker valve 102 owing to high pressure in the noise eliminating chamber 62 and rises to close the lower end opening of the communication path 100.

Figure 4:
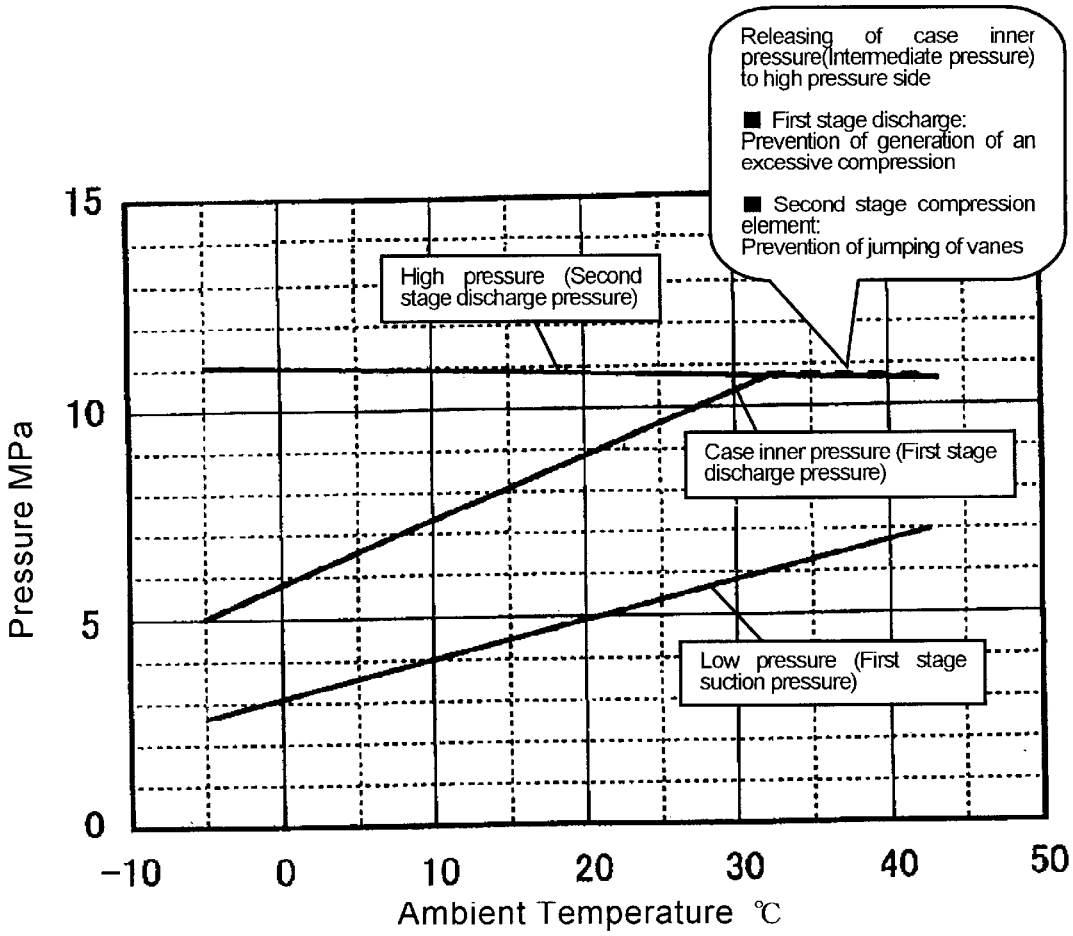
FIG. 4 is a graph showing relations between an ambient temperature and a pressure according to the multistage rotary compressor of the invention.
Figure 5:
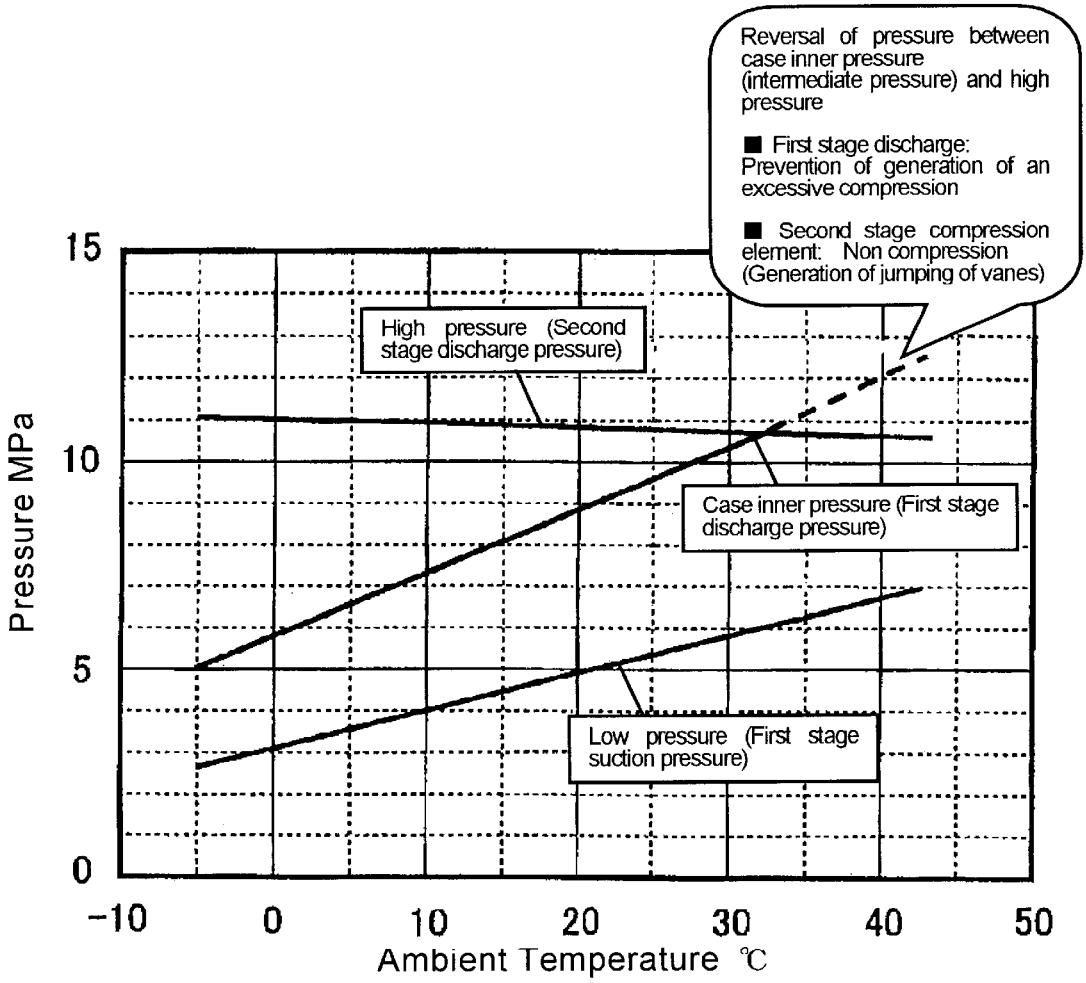
FIG. 5 is a graph showing relations between an ambient temperature and a pressure according to the conventional multistage rotary compressor.
Figure 6:
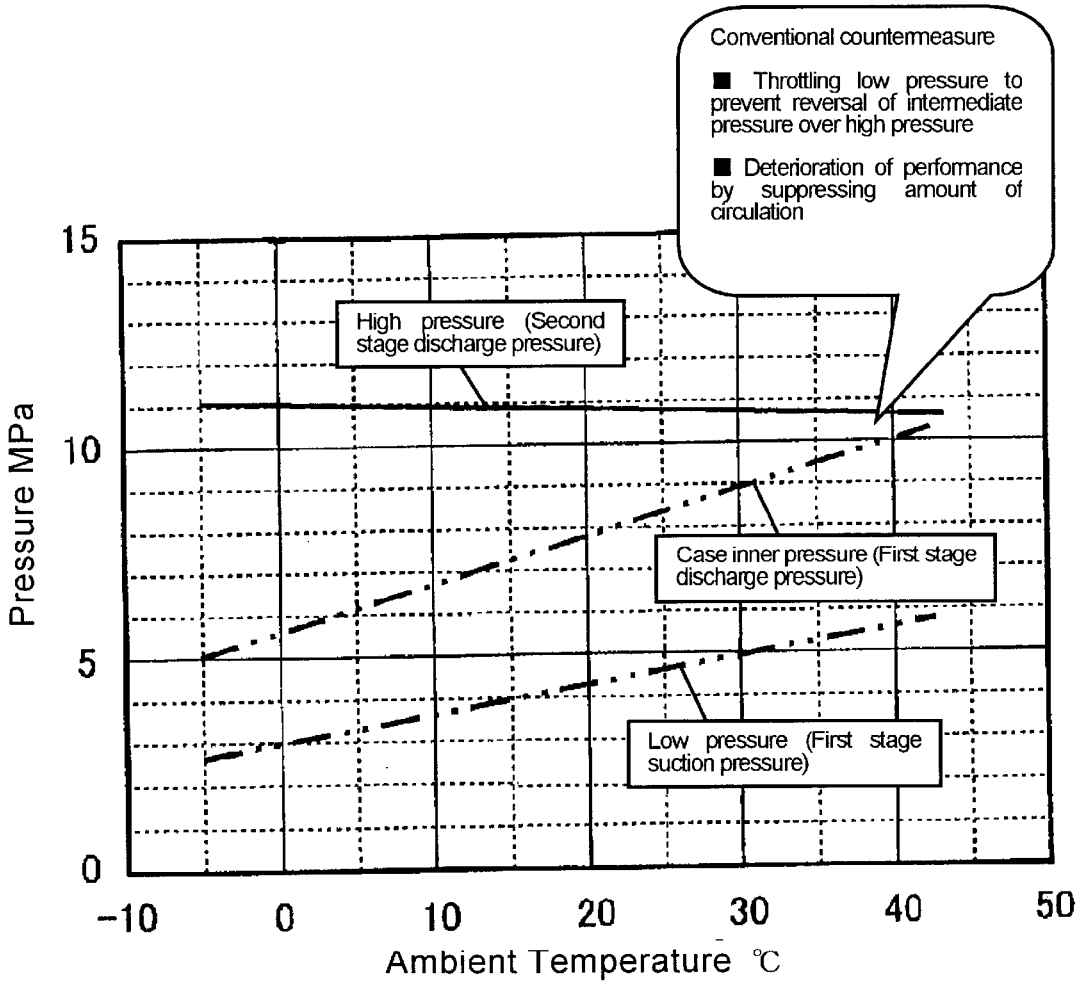
FIG. 6 is another graph showing relations between an ambient temperature and a pressure according to the conventional multistage rotary compressor.

As a result, the intermediate pressure in the hermetic shell case 12 (inner pressure of the case) is controlled not to exceed the high pressure at the refrigerant discharge side of the second rotary compression element 34 as shown in FIG. 4. As a result, it is possible to avoid in advance an unstable operating condition such as jumping of vanes or generation of noises caused by the pressure reversing phenomenon between the refrigerant in the hermetic shell case 12 and a high pressure refrigerant at the refrigerant discharge side of the second rotary compression element 34 without reducing the amount of circulation of the refrigerant in the multistage rotary compressor 10.

With such an arrangement of the multistage rotary compressor, the second object of the invention is achieved, namely, in the multistage rotary compressor using the refrigerant such as carbon dioxide ($CO_2$) which becomes high pressure in discharge pressure, it is possible to prevent the pressure reversing phenomenon where the discharge pressures of the first and second rotary compression elements are reversed, and the amount of circulation of the refrigerant is not reduce, thereby preventing the performance of the compressor from deteriorating. The operation of the multistage rotary compressor will be described later in detail.

According to the first and second embodiments, the carbon dioxide ($CO_2$) which is natural refrigerant is used as a refrigerant of the invention considering earth consciousness, inflammability, toxicity or the like, and an existing oil such as mineral oil, alkylbenzene oil, ether oil, ester oil, or the like is used as the oil of the lubricant.

A refrigeration circuit system using the multistage rotary compressor of the invention according to a fourth embodiment is now described. In the fourth embodiment, the multistage rotary compressor may be any of those shown in FIG. 1 or FIG. 2. In the fourth embodiment, the refrigeration circuit system uses the multistage rotary compressor shown in FIG. 1. In FIG. 1, sleeves 141, 142, 143 and 144 are respectively fixed to the side surface of the shell case 12A of the hermetic shell case 12 by welding at the positions corresponding to a suction path 60 of the upper support member 54 and lower support member 56 (upper side suction path is not shown), the noise eliminating chamber 62, and the upper portion of the upper cover 66 (position substantially corresponding to the lower portion of the electric element 14). The sleeves 141 and 142 adjoin vertically each other and the sleeve 143 is located substantially at a diagonal line of the sleeve 141. The sleeve 144 is positioned while displaced substantially 90° relative to the sleeve 141.

One end of a refrigerant introduction pipe 92 serving as a refrigerant path for introducing the refrigerant in the upper cylinder 38 is inserted into and connected to the sleeve 141, and it communicates with a suction path of the upper cylinder 38, not shown. The refrigerant introduction pipe 92 passes over the hermetic shell case 12 and reaches the sleeve 144, and the other end thereof is inserted into and connected to the sleeve 144 to communicate with the hermetic shell case 12.

One end of a refrigerant introduction pipe 94 for introducing a refrigerant into the lower cylinder 40 is inserted into and connected to the sleeve 142, and it communicates with the drawing path 60 of the lower cylinder 40. The other end of the refrigerant introduction pipe 94 is connected to a lower end of an accumulator, not shown. A refrigerant discharge pipe 96 is inserted into and connected to the sleeve 143, and one end of the refrigerant discharge pipe 96 communicates with the noise eliminating chamber 62.

The accumulator is a tank for separating gas from liquid of the drawn refrigerant, and it is attached to a bracket 147 which is fixed to the upper side surface of the shell case 12A of the hermetic shell case 12 by welding through a bracket at the accumulator side, not shown.

Figure 8:
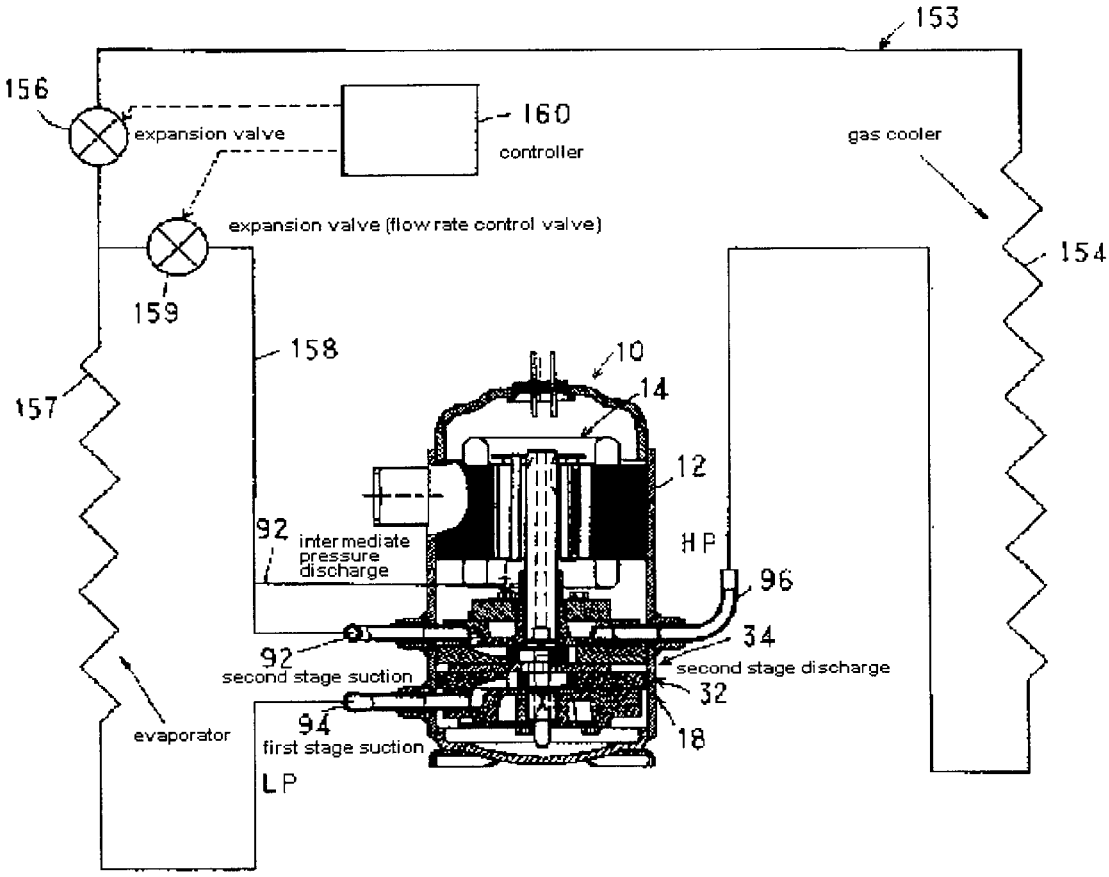
FIG. 8 is a view showing a refrigeration circuit of a hot water supply unit serving as a refrigeration circuit system, according to a fourth embodiment of the invention, to which the invention is applied.

FIG. 8 is a view showing the arrangement of a system type hot water supply unit 153 for heating room or the like to which the refrigeration circuit system using the multistage rotary compressor in FIG. 1 is applied.

That is, the refrigerant discharge pipe 96 of the multistage rotary compressor 10 is connected to an inlet of a gas cooler 154 which is provided in a hot water tank, not shown, of the hot water supply unit 153 in order to heat water to produce hot water. A piping from the gas cooler 154 reaches an inlet of an evaporator 157 via an expansion valve (first electronic expansion valve) 156 serving as a pressure reducing device, and an outlet of the evaporator 157 is connected to the refrigerant introduction pipe 94 via the accumulator (not shown in FIG. 8).

A bypass piping 158 serving as a bypass circuit for supplying the refrigerant compressed by the first rotary compression element 32 to the evaporator 157 is branched from a partway of the refrigerant introduction pipe (refrigerant path) 92 for introducing the refrigerant in the hermetic shell case 12 into the second rotary compression element 34. The bypass piping 158 is connected to a piping between the expansion valve 156 and the evaporator 157 via a flow rate control valve (second electronic expansion valve) 159.

The flow rate control valve 159 is provided for controlling the flow rate of the refrigerant which is supplied to the evaporator 157 through the bypass piping 158, and the degree of opening of the flow rate control valve 159 ranging form full close to full open is controlled by a controller 160 serving as control means. Further, the degree of opening of the expansion valve 156 is controlled by the controller 160 including full open.

The pressures at the refrigerant discharge sides of first and second rotary compression elements 32, 34 are susceptible to an ambient temperature and they are changed. Since the pressure drawn by the first rotary compression element 32 increases as the ambient temperature increases, the pressure at the refrigerant discharge side of the first rotary compression element 32 increases as the ambient temperature increases, so that there is a likelihood that the pressure at the refrigerant discharge side of the first rotary compression element 32 exceeds the pressure at the refrigerant discharge side of the second rotary compression element 34.

The controller 160 is provided with a function to detect an ambient temperature by an ambient temperature sensor or the like, not shown, whereby the controller 160 stores in advance a correlation between such an ambient temperature, the pressure (low pressure) drawn by the first rotary compression element 32, the pressure (intermediate pressure) at the refrigerant discharge side of the first rotary compression element 32, and the pressure (high pressure) at the refrigerant discharge side of the second rotary compression element 34, and also the controller 160 presumes the pressure (intermediate pressure) at the refrigerant discharge side of the first rotary compression element 32 and the pressure of the second rotary compression element 34 based on the ambient temperature, thereby controlling the degree of the opening of the flow rate control valve 159.

That is, in cases where the controller 160 decides that the pressure at the refrigerant discharge side of the first rotary compression element 32 reaches or approaches the pressure at the refrigerant discharge side of the second rotary compression element 34 when the ambient temperature sensor detects the increase of the ambient temperature, the flow rate control valve 159 is controlled by the controller 160 to start opening from the full close state by the decision of the controller 160, and gradually increases the degree of opening depending on the increase of the pressure at the refrigerant discharge side of the first rotary compression element 32 which is predicted from the ambient temperature.

When the flow rate control valve 159 is opened, a part of the refrigerant which is compressed by the first rotary compression element 32 and is discharged into the hermetic shell case 12 is supplied from the refrigerant introduction pipe 92 to the evaporator 157 through the bypass piping 158. Further, since the flow rate control valve 159 is further opened by the controller 160 depending on the increase of the pressure at the refrigerant discharge side of the first rotary compression element 32 which is presumed from the ambient temperature, the flow rate of the refrigerant which is supplied to the evaporator 157 through the bypass piping 158 increases. That is, it is possible to increase the flow rate of the refrigerant which is supplied to the evaporator 157 by the controller 160 via the flow rate control valve 159 as the ambient temperature increases.

Accordingly, the pressure of the intermediate pressure refrigerant, which abnormally increases when the ambient temperature is high, can be reduced by letting out the same toward the evaporator 157 so that the pressure reversing phenomenon between the intermediate pressure and the high pressure can be prevented. As a result, it is possible to avoid the inconvenience that the vane of the second rotary compression element 34 jumps to render the second rotary compression element 34 unstable in operations or the abnormal abrasion of the vane 50 or the generation of noises, so that a reliability of the compressor can be enhanced.

At the time of defrosting operation, the flow rate control valve 159 and the expansion valve 156 are fully opened by the controller 160. Consequently, the intermediate pressure refrigerant which is compressed by the first rotary compression element 32 in addition to the high pressure refrigerant which is compressed by the second rotary compression element 34 and passes through the gas cooler 154 and also passes through the expansion valve 156 which is fully opened by the controller 160 can be supplied to the evaporator 157 so that the frost generated in the evaporator 157 can be efficiently defrosted. Further, it is possible to prevent the pressure reversing phenomenon between the pressures at the refrigerant discharge sides of the second rotary compression element 34 and the first rotary compression element 32 during the defrosting time.

The operations of respective embodiments of the invention are now described. When the stator coil 28 of the electric element 14 is energized via the terminal 20 and the wiring, not shown, in the multistage rotary compressor 10 shown in FIG. 1, the electric element 14 is operated to rotate the rotor 24. When the rotor 24 is rotated, the upper and lower rollers 46, 48 are engaged with the upper and lower eccentric portions 42, 44 which are integrally provided with the rotary shaft 16 to rotate eccentrically in the upper and lower cylinders 38, 40.

As a result, a lower pressure refrigerant which is drawn into the low pressure chamber of the lower cylinder 40 through the drawing port, not shown, via the suction path 60 formed in the lower support member 56 is compressed by the operations of the lower roller 48 and the vane 52 to be changed into an intermediate pressure. Consequently, the discharge valve 131 provided in the noise eliminating chamber 64 is opened to allow the noise eliminating chamber 64 to communicate with the discharge port 41 so that the refrigerant passes from the high pressure chamber of the lower cylinder 40 through the discharge port 41, and is discharged to the noise eliminating chamber 64 formed in the lower support member 56. The refrigerant discharged into the noise eliminating chamber 64 is discharged from the intermediate discharge pipe 121 into the hermetic shell case 12 through the communication port, not shown.

The intermediate pressure refrigerant in the hermetic shell case 12 passes through the refrigerant path, not shown, and it is drawn into the low pressure chamber of the upper cylinder 38 through the drawing port, not shown, through the drawing path, not shown, formed in the upper support member 54. The intermediate pressure refrigerant thus drawn is subjected to compression of second stage by the operations of the upper roller 46 and the vane 50 to be changed into a high temperature and high pressure refrigerant. As a result, the discharge valve 127 provided in the noise eliminating chamber 62 is opened to allow the noise eliminating chamber 62 to communicate with the discharge port 39 so that the refrigerant passes in the discharge port 39 from the high pressure chamber of the upper cylinder 38, and it is discharged toward the noise eliminating chamber 62 formed in the upper support member 54.

The high pressure refrigerant discharged toward the noise eliminating chamber 62 passes through the refrigerant path, not shown, and flows into a radiator, not shown, of the refrigeration circuit provided outside the multistage rotary compressor 10.

The refrigerant which flowed into the radiator radiates heat and performs an heating operation. The refrigerant which flows out from the radiator is decompressed by a pressure reducing device (expansion valve or the like), not shown, of the refrigeration circuit then it enters the evaporator and is evaporated therein. The refrigerant is finally drawn into the suction path 60 of the first rotary compression element 32 and the circulation of the refrigerant is repeated.

Since the ratio of the S2/S1 is set to be smaller than the ratio of V2/V1, where S1 is an area of the discharge port 41 of the first rotary compressor element 32, S2 is an area of the discharge port 39 of the second rotary compression element 34, V1 is displacement of the first rotary compression element 32, and V2 is displacement of the second rotary compression element 34, if the area S2 of the discharge port 39 of the second rotary compression element 34 is further reduced, the amount of the refrigerant remaining in the discharge port 39 can be further reduced.

As a result, the amount of re-expansion of the refrigerant in the discharge port 39 of the second rotary compression element 34 can be reduced, thereby reducing the pressure loss caused by the re-expansion of the high pressure so that the performance of the multistage rotary compressor can be improved to a large extent.

Although the ratio of S2/S1 is set to be not less than 0.55 to not more than 0.85 times as large as the ratio of V2/V1 according to the embodiments, the ratio is not limited thereto, and hence if the ratio of S2/S1 is set to be smaller than the ratio of V2/V1, the same effect set forth above can be expected.

In cases where the multistage rotary compressor 10 is employed under the circumstances where the flow rate of refrigerant is small, for example, at a cold district, the ratio of S2/S1 is set to be not less than 0.55 to not more than 0.67 times as large as the ratio of V2/V1 so that the amount of refrigerant remaining in the discharge port 39 of the second rotary compression element 34 can be further reduced to obtain more efficient effect.

In cases where the multistage rotary compressor 10 is employed under the circumstances where the flow rate of refrigerant is large, for example, at a warm district, the ratio of S2/S1 is set to be not less than 0.69 to not more than 0.85 times as large as the ratio of V2/V1 so that the increase of the passage resistance of the second rotary compression element 34 is restrained as much as possible, thereby enhancing the performance of the compressor.

The operation of the multistage rotary compressor 10 shown in FIG. 2 is now described. When the stator coil 28 of the electric element 14 is energized via the terminal 20 and the wiring, not shown, in the same manner as the multistage rotary compressor 10 shown in FIG. 1, the electric element 14 is operated to rotate the rotor 24. When the rotor 24 is rotated, the upper and lower rollers 46, 48 are engaged with the upper and lower eccentric portions 42, 44 which are integrally provided with the rotary shaft 16 to rotate eccentrically in the upper and lower cylinders 38, 40.

As a result, the refrigerant of a low pressure which is drawn into the low pressure chamber of the lower cylinder 40 through the suction port 162, not shown, via the suction path 60 formed in the lower support member 56 is compressed by the operations of the lower roller 48 and the vane, not shown, to be changed into an intermediate pressure, which in turn passes from the high pressure chamber of the lower cylinder 40 through the discharge port, not shown, and passes through the noise eliminating chamber 64 formed in the lower support member 56, then it is discharged from the intermediate discharge pipe 121 to the compression 12 through the communication port, not shown.

The intermediate pressure refrigerant in the hermetic shell case 12 passes through the refrigerant path, not shown, and drawn into the low pressure chamber of the upper cylinder 38 through the suction port 161, via the suction path 58 formed in the upper support member 54. The intermediate pressure refrigerant thus drawn is subjected to a compression of second stage by the operations of the upper roller 46 and the vane, not shown, to be changed into a high temperature and high pressure refrigerant. Accordingly, the discharge valve 127 provided in the noise eliminating chamber 62 is opened to allow the noise eliminating chamber 62 to communicate with the discharge port 39 so that the refrigerant passes in the discharge port 39 from the high pressure chamber of the upper cylinder 38, and it is discharged toward the noise eliminating chamber 62 formed in the upper support member 54.

In this case, when the pressure of the refrigerant in the hermetic shell case 12 is less than the pressure of the refrigerant in the noise eliminating chamber 62, the release valve 101 is brought into contact with the communication path 100 to seal it so that the communication path 100 is not opened. As a result, the high pressure refrigerant discharged toward the noise eliminating chamber 62 passes through-the refrigerant path, not shown, and flows into the radiator, not shown, of the refrigeration circuit provided out of the multistage rotary compressor 10.

The refrigerant which flowed into the radiator radiates heat and performs an heating operation. The refrigerant which flows out from the radiator is decompressed by a pressure reducing device (expansion valve or the like) of the refrigeration circuit, not shown, then it enters the evaporator, not shown, and is evaporated therein. The refrigerant is finally drawn into the suction path 60 of the first rotary compression element 32 and the circulation of the refrigerant is repeated.

When the pressure of the refrigerant in the hermetic shell case 12 is higher than the pressure of the refrigerant in the noise eliminating chamber 62, as set forth before, the release valve 101 which is brought into contact with the lower end opening of the communication path 100 is pushed down by the pressure in the hermetic shell case 12 and is moved away from the lower end opening of the communication path 100 so that the communication path 100 communicates with the noise eliminating chamber 62 and the refrigerant in the hermetic shell case 12 which abnormally increases flows into the noise eliminating chamber 62. The refrigerant which flowed into the noise eliminating chamber 62 is compressed by the second rotary compression element 34 and passes through the refrigerant path, not shown, together with the refrigerant which is discharged into the noise eliminating chamber 62 and flows into the radiator. This circulation is repeated.

When the pressure of the refrigerant in the hermetic shell case 12 is less than the pressure of the refrigerant in the noise eliminating chamber 62, the release valve 101 is brought into contact with the communication path 100 to seal it so that the communication path 100 is blocked off by the release valve 101.

Inasmuch as the multistage rotary compressor comprises the communication path 100 for communicating the path through which the intermediate pressure refrigerant which is compressed by the first rotary compression element 32 flows, with the refrigerant discharge side of the second rotary compression element 34, and the release valve 101 for-opening and closing the communication path 100, the release valve 101 opens the communication path 100 in cases where the pressure of the intermediate pressure refrigerant is higher than the pressure at the refrigerant discharge side of the second rotary compression element 34, thereby avoiding in advance an unstable operating condition caused by the pressure reversing phenomenon between the pressures at the refrigerant discharge sides of the first rotary compression element 32 and second rotary compression element 34 without reducing the amount of circulation of the refrigerant in the compressor.

Inasmuch as the intermediate pressure refrigerant which is compressed by the first rotary compression element 32 is discharged into the hermetic shell case 12 and the second rotary compression element 34 draws the intermediate pressure refrigerant in the hermetic shell case 12 while the communication path 100 is formed in the upper cover 66 serving as a wall for forming the noise eliminating chamber 62, and the hermetic shell case 12 and the noise eliminating chamber 62 communicate with each other and further the release valve 101 is provided in the noise eliminating chamber 62 so that the entire dimensions of the multistage rotary compressor can be made small. Further, since the open valve 101 is provided on the upper cover 66 inside the noise eliminating chamber 62, it is possible to avoid the pressure reversing phenomenon between the intermediate pressure and high pressure by configuring the communication path 100 in a complex structure.

Figure 7:
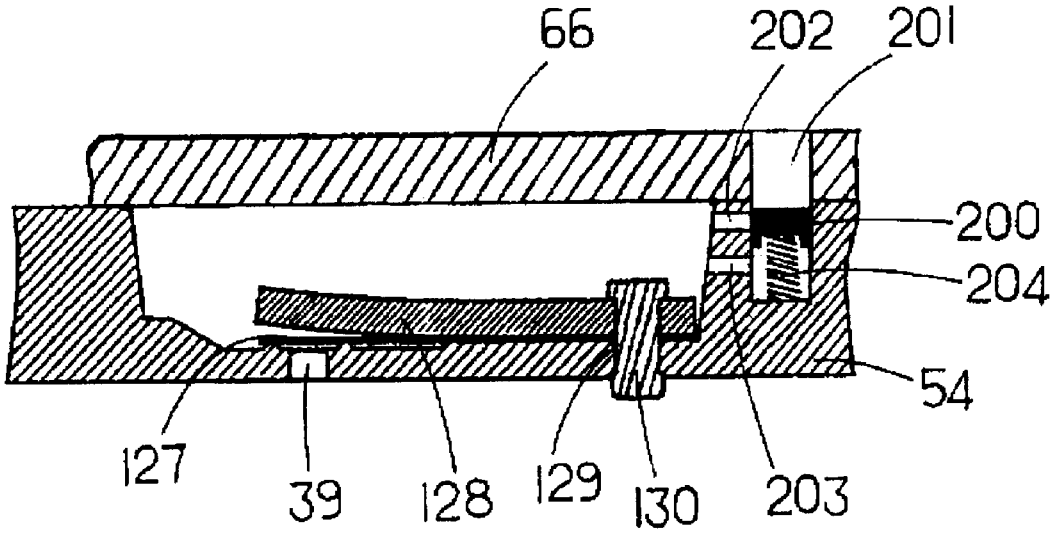
FIG. 7 is an enlarged sectional view of a communication path of a second rotary compression element of the multistage rotary compressor according to a third embodiment of the invention.

Although the release valve 101 is attached to the lower surface of the upper cover 66 and disposed in the noise eliminating chamber 62 in the embodiments, it is not limited thereto, and hence it may be configured such that a valve unit having different structure but performing the same function as the release valve 101 may be provided in the communication path 100, for example, as shown in the structure in FIG. 7. In FIG. 7, a valve unit accommodation chamber 201 is provided in the upper support member 54 and the upper cover 66, and a first path 202 formed in the upper support member 54 at the upper side thereof and a second path 203 formed under the first path 202 communicate with the valve unit accommodation chamber 201 and noise eliminating chamber 62.

The valve unit accommodation chamber 201 is a hole formed vertically in the upper cover 66 and the upper support member 54, and it opens to the hermetic shell case 12 at the upper surface. A substantially cylindrical valve unit 200 is accommodated in the valve unit accommodation chamber 201 and it is configured such that it is brought into contact with a wall face of the valve unit accommodation chamber 201 to seal it. A freely elastic spring 204 (urging member) is brought into contact with the lower surface of the valve unit 200 at one end. The spring 204 is fixed to the upper support member 54 at the other end, and the valve unit 200 is always urged upward by the spring 204.

The multistage rotary compressor is further configured such that the high pressure refrigerant in the noise eliminating chamber 62 flows into the valve unit accommodation chamber 201 from the second path 203 to urge the valve unit 200 upward while the intermediate pressure refrigerant in the hermetic shell case 12 flows into the valve unit accommodation chamber 201 to urge the valve unit 200 downward from the upper surface of the valve unit 200.

In such a manner, the valve unit 200 is urged at the side where it is brought into contact with the spring 204, namely, it is urged upward by the high pressure refrigerant in the noise eliminating chamber 62 and the spring 204 from the lower side, whereupon it is urged downward by the intermediate pressure refrigerant in the hermetic shell case 12 from the opposite side. The valve unit 200 always blocks off the first path 202 which communicates with the valve unit accommodation chamber 201.

Supposing that the urging force of the spring 204 is set such that the valve unit 200 which blocks off the first path 202 is pushed down by the refrigerant in the hermetic shell case 12 to allow the refrigerant in the hermetic shell case 12 to flow into the first path 202 when the pressure of the refrigerant in the hermetic shell case 12 is higher than the pressure of the refrigerant in the noise eliminating chamber 62. Further, the spring 204 is set such that the valve unit 200 is always positioned over the second path 203.

When the pressure of the refrigerant in the hermetic shell case 12 exceeds the pressure of the refrigerant in the noise eliminating chamber 62, the valve unit 200 is pushed downward under the first path 202 so that the refrigerant in the hermetic shell case 12 flows into the noise eliminating chamber 62 through the first path 202. Then when the pressure of the refrigerant in the hermetic shell case 12 is less than the pressure of the refrigerant in the noise eliminating chamber 62, the valve unit 200 is structured to block off the first path 202.

Even in such an arrangement, the intermediate pressure can be controlled to be lower the pressure at the refrigerant discharge side of the second rotary compression element 34 by the valve unit 200, thereby avoiding in advance the inconvenience of the pressure reversing phenomenon where the pressure at the refrigerant suction side of the second rotary compression element 34 and the pressure at the refrigerant discharge side thereof are reversed, and also avoiding an unstable operating condition and the generation of noises without reducing the amount of circulation of the refrigerant so that the deterioration of the performance of the multistage rotary compressor can be avoided.

Since the height dimension of the noise eliminating chamber 62 can be controlled as much as possible, the entire dimensions of the compressor can be made smaller.

Although the communication path is formed on the upper cover 66 according to the embodiment, it is not limited thereto, and hence it is not necessary to specify the position of the communication path if it is provided at the portion where the path through which the refrigerant of the first rotary compression element 32 is discharged communicates with the refrigerant discharge side of the second rotary compression element 34.

Although the multistage rotary compressor where the rotary shaft 16 is a vertically installed type is explained with reference to FIGS. 1 and 2, it is needless to say that the invention can be applied to the multistage rotary compressor where the rotary shaft 16 is a laterally installed type.

Still further, although the multistage rotary compressor 10 is explained as the second stage type multistage rotary compressor provided with the first and second rotary compression elements, it is not limited thereto, and it is sufficient that the multistage rotary compressor may be provided with the third and fourth or more rotary compression elements.

The operation of the refrigeration circuit system of the invention shown in FIG. 8 is now described. The flow rate control valve 159 is closed by the controller 160 in a normal heating operation, and the expansion valve 156 is controlled to be opened or closed by the controller 160 so as to perform the decompression operation.

Then, when the stator coil 28 of the electric element 14 is energized via the terminal 20 shown in FIG. 1 and the wiring, not shown, the electric element 14 is operated to rotate the rotor 24. When the rotor 24 is rotated, the upper and lower rollers 46, 48 which are engaged with the upper and lower eccentric portions 42, 44 integrally provided with the rotary shaft 16 are rotated eccentrically in the upper and lower cylinders 38, 40.

As a result, a low pressure refrigerant which is drawn into the low pressure chamber of the lower cylinder 40 through the refrigerant introduction pipe 94, the suction port, not shown, via the suction path 60 formed in the lower support member 56 is compressed by the operations of the lower roller 48 and the vane 52 to be changed into an intermediate pressure, then the refrigerant in the high pressure chamber of the lower cylinder 40 passes through the noise eliminating chamber 64 formed in the lower support member 56 via the discharge port, not shown, and is discharged from the intermediate discharge pipe 121 into the hermetic shell case 12 through the communication port, not shown. As a result, the pressure in the hermetic shell case 12 is changed into the intermediate pressure.

In the circumstances where the ambient temperature is low and the pressure at the refrigerant discharge side of the first rotary compression element 32 is low, the flow rate control valve 159 is closed by the controller 160 as set forth before so that the intermediate pressure refrigerant flows out from the refrigerant introduction pipe 92 of the sleeve 144 and passes through the suction path 58 formed in the upper support member 54 and it is drawn into the low pressure chamber of the upper cylinder 38 through the suction port, not shown.

Meanwhile, if the controller 160 presumes that the ambient temperature increases and the pressure at the refrigerant discharge side of the first rotary compression element 32 reaches or approaches the pressure at the refrigerant discharge side of the second rotary compression element 34, the flow rate control valve 159 is gradually opened as set forth before so that a part of the refrigerant at the refrigerant discharge side of the first rotary compression element 32 passes through the bypass piping 158 from the refrigerant introduction pipe 92 of the sleeve 144 and is supplied to the evaporator 157 via the flow rate control valve 159. Further, when the ambient temperature further increases, the flow rate control valve 159 is further opened by the controller 160 so that the flow rate of the refrigerant which passes through the bypass piping 158 increases. As a result, the pressure of the intermediate pressure refrigerant in the hermetic shell case 12 lowers, thereby avoiding a pressure reversing phenomenon between the pressures at the refrigerant discharge sides of the first rotary compression element 32 and the second rotary compression element 34.

Meanwhile, provided that the ambient temperature lowers, e.g., to reach a predetermined temperature, the flow rate control valve 159 is closed by the controller 160 so that the entire intermediate pressure refrigerant in the hermetic shell case 12 flows out from the refrigerant introduction pipe 92 of the sleeve 144 and passes through the suction path 58 formed in the upper support member 54, then it is drawn into the low pressure chamber of the upper cylinder 38 through the suction port, not shown.

The intermediate pressure refrigerant which is drawn into the second rotary compression element 34 is subjected to compression of second stage by the operations of the upper roller 46 and the vane 50, and it is changed into a high temperature and high pressure refrigerant, which in turn passes the discharge port, not shown, from the high pressure chamber, and also passes through the noise eliminating chamber 62 formed in the upper support member 54, then flows into the gas cooler 154 via the refrigerant discharge pipe 96. The temperature of the refrigerant at this time increases up to +100° C., and the refrigerant having such a high temperature and high pressure radiates heat from the gas cooler 154, and heats water in the hot water tank to generate hot water of about +90° C.

The refrigerant per se is cooled in the gas cooler 154 and flows out from the gas cooler 154. Then the refrigerant is decompressed by the expansion valve 156 and flows into the evaporator 157 where it is evaporated (absorbs heat from the periphery at this time) and passes through the accumulator, not shown, and it is drawn into the first rotary compression element 32 through the refrigerant introduction pipe 94. This cycle is repeated.

When the frost is generated in the evaporator 157 during the heating operation, the controller 160 fully opens the expansion valve 156 and flow rate control valve 159 based on a periodic or arbitrary instruction operation, thereby performing defrosting operation of the evaporator 157. As a result, the high temperature and high pressure refrigerant which is discharged from the second rotary compression element 34 flows through the refrigerant discharge pipe 96, the gas cooler 154 and the expansion valve 156 (full open state) while the refrigerant in the hermetic shell case 12 which is discharged from the first rotary compression element 32 flows through the refrigerant introduction pipe 92, the bypass piping 158, the flow rate control valve 159 (full open state) and flows downstream side of the expansion valve 156, whereby both the refrigerants discharges from the second rotary compression element 34 and first rotary compression element 32 are not decompressed and directly flows into the evaporator 157. The evaporator 157 is heated when the high temperature refrigerant flows thereinto so that the frost in the evaporator 157 is fused and eliminated.

Such a defrosting operation terminates by a predetermined defrosting termination temperature and time or the like of the evaporator 157. Upon termination of the defrosting operation of the evaporator 157, the controller 160 closes the flow rate control valve 159 and controls the expansion valve 156 so that the expansion valve 156 can perform a normal decompressing operation, and the refrigerant returns to perform a normal heating operation.

Inasmuch as the multistage rotary compressor comprises the bypass piping 158 for supplying the refrigerant discharged from the first rotary compression element 32 to the evaporator 157, the flow rate control valve 159 capable of controlling the flow rate of the refrigerant which flows through the bypass piping 158, and the controller 160 for controlling the flow rate control valve 159 and the expansion valve 156 serving as the pressure reducing device, wherein the controller 160 always closes the flow rate control valve 159 and increases the flow rate of the refrigerant which flows through the bypass piping 158 by the flow rate control valve 159 depending on the increase of the pressure at the refrigerant discharge side of the first rotary compressor element 32, the pressure reversing phenomenon between the intermediate pressure and the high pressure can be avoided, and an unstable operating condition of the second rotary compression element 34 can be avoided, thereby enhancing a reliability of the compressor.

That is, when the pressure at the refrigerant discharge side of the first rotary compression element 32 approaches the pressure at the refrigerant discharge side of the second rotary compression element 34, the controller 160 opens the flow rate control valve 159 so that the pressure reversing phenomenon between the intermediate pressure and the high pressure can be avoided without fail Particularly, since the controller 160 fully opens the expansion valve 156 and the flow rate control valve 159 when defrosting in the evaporator 157, the frost generated in the evaporator 157 can be eliminated by the intermediate pressure refrigerant and the refrigerant compressed by the second rotary compression element 34 so that the frost generated in the evaporator 157 can be efficiently eliminated and the inconvenience of the pressure reversing phenomenon between the pressure at the refrigerant discharge side of the second rotary compression element 34 and the pressure at the refrigerant drawing side thereof can be also avoided.

Although the controller 160 presumed the pressure at the refrigerant discharge side of the first rotary compression element 32 and the pressure at the refrigerant discharge side of the second rotary compression element 34 by detecting the ambient temperature by an ambient temperature sensor, not shown, according to the embodiment of the invention, it is sufficient that the pressure at the refrigerant discharge side of the first rotary compression element 32 and the pressure at the refrigerant discharge side of the second rotary compression element 34 are presumed by detecting the pressure at the refrigerant suction side of the first rotary compression element 32 by a pressure sensor which is provided at the refrigerant suction side of the first rotary compression element 32. Further, the pressures at the refrigerant discharge sides of the first rotary compression element 32 and the second rotary compression element 34 may be controlled by directly detecting the same pressures.

Although the opening and closing operation of the flow rate control valve 159 is controlled when the pressure at the refrigerant discharge side of the first rotary compression element 32 reaches or approaches the pressure at the refrigerant discharge side of the second rotary compression element 34, it is not limited thereto, and hence the controller 160 controls the flow rate control valve 159 to open it when the pressure reaches a predetermined pressure, for example, the pressure in the hermetic shell case 12 reaches or approaches an allowable pressure of the hermetic shell case 12. In such a case it is possible to avoid in advance an inconvenience that the pressure in the hermetic shell case 12 exceeds the allowable limit which is caused by the increase of the pressure at the refrigerant discharge side of the first rotary compression element 32, so that it is possible to avoid an inconvenience of the breakage of the hermetic shell case 12 or the generation of leakage of the refrigerant owing to the increase of the intermediate pressure refrigerant.

Although carbon dioxide is used as the refrigerant in the embodiments, the refrigerant is not limited to the carbon dioxide but a refrigerant having a pressure which is large in difference between high and low pressures can be used.

Although the multistage rotary compressor 10 is used in the refrigeration circuit system unit of the hot water supply unit 153, it is not limited thereto, and hence the invention is effective even if the multistage rotary compressor 10 is used for heating room or the like.

As mentioned in detail above, the amount of high pressure refrigerant remaining in the discharge port of the second rotary compression element can be reduced by rendering the area S2 of the discharge port of the second rotary compression element smaller so that the amount of re-expansion of the refrigerant in the discharge port of the second rotary compression element can be reduced, thereby restraining the lowering of the compression efficiency owing to the re-expansion of the high pressure refrigerant. Further, since the volume flow of the refrigerant in the discharge port of the second rotary compression element is very small, the efficiency improvement by the reduction of the re-expansion of the remaining refrigerant exceeds the loss caused by the increase of the passage resistance in the discharge port, so that an operation efficiency of the rotary compressor can be improved on the whole.

What is claimed is:

1. A multistage rotary compressor comprising an electric element in a hermetic shell case, and first and second rotary compression elements being driven by said electric element, wherein a refrigerant which is compressed and discharged by said first rotary compression element is drawn into and compressed by said second rotary compression element and discharged thereby;

said multistage rotary compressor being characterized in that ratio of S2/S1 is set to be smaller than ratio of V2/V1, where S1 is an area of a discharge port of said first rotary compression element, S2 is an area of a discharge port of said second rotary compression element, V1 is displacement of said first rotary compression element, and V2 is displacement of said second rotary compression element.

2. The multistage rotary compressor according to claim 1, wherein the ratio of S2/S1 is set to be not less than 0.55 to not more than 0.85 times as large as the ratio of V2/V1.

3. The multistage rotary compressor according to claim 2, wherein the ratio of S2/S1 is set to be not less than 0.55 to not more than 0.67 times as large as the ratio of V2/V1.

4. The multistage rotary compressor according to claim 2, wherein the ratio of S2/S1 is set to be not less than 0.69 to not more than 0.85 times as large as the ratio of V2/V1.

5. A multistage rotary compressor comprising an electric element in a hermetic shell case, and first and second rotary compression elements being driven by said electric element, wherein an intermediate pressure refrigerant which is compressed by said first rotary compression element is drawn and compressed by said second rotary compression element and discharged thereby, said multistage rotary compressor comprising:

a communication path for communicating between a path through which the intermediate pressure refrigerant compressed by said first rotary compression element flows and a refrigerant discharge side of said second rotary compression element, and a valve unit for opening and closing said communication path, wherein said valve unit opens said communication path when a pressure of the intermediate pressure refrigerant becomes higher than a pressure at the refrigerant discharge side of the second compression element.

6. The multistage rotary compressor according to claim 5, further comprising:

a cylinder constituting said second rotary compression element;

a noise eliminating chamber for discharging the refrigerant compressed in said cylinder;

wherein the intermediate pressure refrigerant which is compressed by said first rotary compression element is discharged into said hermetic shell case, and said second rotary compression element draws the intermediate pressure refrigerant in said hermetic shell case thereinto;

and wherein said communication path is formed in a wall forming said noise eliminating chamber for allowing said hermetic shell case to communicate with said noise eliminating chamber, and said valve unit is provided in said noise eliminating chambers or said communication path.

7. A refrigeration circuit system comprising a multistage rotary compressor formed of an electric element in a hermetic shell case, and first and second rotary compression elements being driven by said electric element, wherein a refrigerant which is compressed by said first rotary compression element is compressed by said second rotary compression element, a gas cooler into which the refrigerant discharged from said second rotary compression element flows, a pressure reducing device connected to an outlet side of said gas cooler, and an evaporator connected to an outlet side of said pressure reducing device, wherein the refrigerant discharged from said evaporator is compressed by said first rotary compression element, said refrigeration circuit system further comprising:

a bypath circuit for supplying the refrigerant discharged from said first rotary compression element to said evaporator;

a flow regulating valve capable of controlling flow rate of the refrigerant flowing in said bypath circuit; and control means for controlling said flow regulating valve and said pressure reducing device;

wherein said control means normally closes said flow regulating valve and increases flow rate of the refrigerant flowing in said bypath circuit by said flow regulating valve in response to the increase of pressure at the refrigerant discharge side of said first rotary compression element.

8. The refrigeration circuit system according to claim 7, wherein the refrigerant compressed by said first rotary compression element is discharged into said hermetic shell case and said second rotary compression element draws the refrigerant in said hermetic shell case thereinto; and wherein said control means opens said flow regulating valve when a pressure in said hermetic shell case reaches a predetermined pressure.

9. The refrigeration circuit system according to claim 7, wherein said control means opens the flow regulating valve when a pressure at the refrigerant discharge side of said first rotary compression element is higher than or approaches a pressure at the refrigerant discharge side of said second rotary compression element.

10. The refrigeration circuit system according to claim 7, 8 and 9 wherein said control means fully opens both said pressure reducing device and said flow regulating valve when defrosting of said evaporator.

* * * * *